US005937582A

United States Patent [19]

Taylor

[11] Patent Number: 5,937,582

[45] **Date of Patent: *Aug. 17, 1999**

[54] ROTARY WINDOW OPERATOR

[75] Inventor: Nigel Alan Colebrooke Taylor, Wellington, New Zealand

[73] Assignee: Interlock Industries Limited, New Zealand

[ * ] Notice: This patent issued on a continued prosecution application filed under 37 CFR 1.53(d), and is subject to the twenty year patent term provisions of 35 U.S.C. 154(a)(2).

[21] Appl. No.: 08/669,433

[22] PCT Filed: Dec. 21, 1994

[86] PCT No.: PCT/NZ94/00150

§ 371 Date: Jun. 21, 1996

§ 102(e) Date: Jun. 21, 1996

[87] PCT Pub. No.: WO95/18284

PCT Pub. Date: Jul. 6, 1995

[30] Foreign Application Priority Data

Dec. 22, 1993 [NZ] New Zealand ..... 250557
Sep. 8, 1994 [NZ] New Zealand ..... 264431

[51] Int. Cl.[6] ..... E05F 11/24; G05G 1/00

[52] U.S. Cl. ..... 49/341; 49/342; 49/343; 74/547

[58] Field of Search ..... 49/460, 339, 341, 49/342, 343, 344, 345, 346, 347; 74/527, 547, 528, 545, 546, 548, 557, 439; 16/DIG. 24; 403/359, 33, 30, 179, 404

[56] References Cited

U.S. PATENT DOCUMENTS

| | | | |
|---|---|---|---|
| 2,859,635 | 11/1958 | Lee | 74/439 |
| 3,007,348 | 11/1961 | Barnes | 74/547 |
| 3,091,978 | 6/1963 | Rubinstein | 74/547 |
| 3,948,117 | 4/1976 | Kimura | 74/547 |
| 4,466,658 | 8/1984 | Furst et al. | 74/547 |
| 4,586,262 | 5/1986 | Back | 33/197 |
| 4,829,846 | 5/1989 | DeSalvo et al. | 74/547 |
| 5,037,066 | 8/1991 | Kerger et al. | 74/548 |
| 5,097,629 | 3/1992 | Guhl et al. | 49/386 |
| 5,168,770 | 12/1992 | Ellis | 74/547 |
| 5,201,241 | 4/1993 | Polack, Jr. | 74/547 |
| 5,279,173 | 1/1994 | Blaszynski et al. | 74/439 |
| 5,531,045 | 7/1996 | Piltingsrud | 49/341 |

*Primary Examiner*—Daniel P. Stodola
*Assistant Examiner*—Curtis Cohen
*Attorney, Agent, or Firm*—Blakely Sokoloff Taylor & Zafman

[57] ABSTRACT

A rotary window operator to effect opening and closing of a window. A rotatable handle (14) is mounted on a housing (10) from which a link member (16) projects. The handle (14) is pivotally coupled to a cage (29) in which a bush (30) is slidingly engaged. A cam surface (25) of handle (14) forces teeth on bush (30) to engage with teeth of cage (29) when the handle (14) is pivoted from a non-use position to an in-use position. A drive shaft coupled to the bush (30) has a gear which meshes with gear wheel (18) of link member whereby rotation of the handle (14), when in the in-use position, imparts movement in link member (16).

30 Claims, 12 Drawing Sheets

ROTARY WINDOW OPERATOR

BACKGROUND OF THE INVENTION

This invention relates to an operator for a window especially a window of the casement type.

Window operators of a type having a linkage connected between the window sash and window frame with the linkage being actuated by a rotatable handle are known. Such operators typically can include a housing with which the handle is rotatably mounted. A gear mechanism couples a drive from the handle to the linkage. Thus rotation of the handle causes the linkage to move relative to the housing such that the linkage pivots to thereby cause a window sash coupled to the linkage to move to respective open or closed positions in the window frame.

It is known to have the handle arranged such that it can be moved into a parked or non-use position where it does not project from the housing. This ability to move the handle into a "parked" position reduces the possibility of someone or something being snagged by or entangling with the handle. It also improves the aesthetics of the operator when it is not in use.

However, with known arrangements the handle must be rotated to a prescribed position where it can be folded away into the non-use position. In addition even when folded away the handle remains coupled to the gear mechanism/linkage.

SUMMARY OF THE INVENTION

It is therefore one object of the present invention to provide a rotary window operator whereby irrespective of the angular position of the handle the handle can be moved into a non-use position and disconnected from the drive mechanism/linkage of the operator.

Broadly therefore in one aspect of the invention there is provided a rotary window operator which includes a rotatable handle drivingly coupled to a link member such that movement of the link member to effect opening and closing of a window is achieved by rotation of the handle, the handle being movable into a non-use position whereupon coupling means providing the drive coupling between the handle and the link member is disconnected, the coupling means permitting the handle to be movable into the non-use position at any angular disposition of the handle.

Known window operators also suffer from somewhat fiddley and time consuming installation requirements. This usually arises because the mounting arrangement includes a number of separate components which the installer must manipulate and support during the installation procedure.

Accordingly a further object of the present invention is to provide a rotary window operator which is straight forward and convenient to install in a window frame.

Broadly in a second aspect of the invention there is provided a rotary window operator which includes a housing from which a mounting projects said mounting being engageable through an opening in a window frame, said mounting incorporating at least one clamping element, the clamping element being located in a first position which does not hinder the insertion of the mounting through said opening but is movable to a second position whereby it can engage with part of the frame defining the opening and thereby restrict retraction of the mounting through said opening.

In the following more detailed description of the invention reference will be made to the accompanying drawings in which:

FIG. 1 is a perspective view of the rotary window operator according to one embodiment, FIG. 2 is a plan view of the operator as shown in FIG. 1, FIG. 3 is a detail illustration of the handle when in the operative position, FIG. 4 is a detailed view of the handle when moved to the non-use position, FIG. 5 is a perspective view of a drive gear wheel mounted with the link member, FIG. 6 is a similar view to FIG. 5 showing the gear wheel fixedly attached to the link member, FIG. 7 is a plan view of the operator showing in detail a means whereby the housing thereof can be mounted to a window frame, FIG. 8 is an end section view taken on line A—A of FIG. 7 and showing a window frame associated with the operator, FIG. 9 is a perspective view of the operator showing the mounting arrangement illustrated in FIGS. 7 and 8, FIG. 10 is a sectioned perspective view of the base of the housing, FIG. 11 is a perspective view of a further form of the operator, FIG. 12 is a perspective view of a series of screw fixing placement inserts for the operator, and FIG. 13 is a plan view showing the relative positions of the screw fixing placements when using the inserts of FIG. 12.

DETAILED DESCRIPTION

Figure 1:
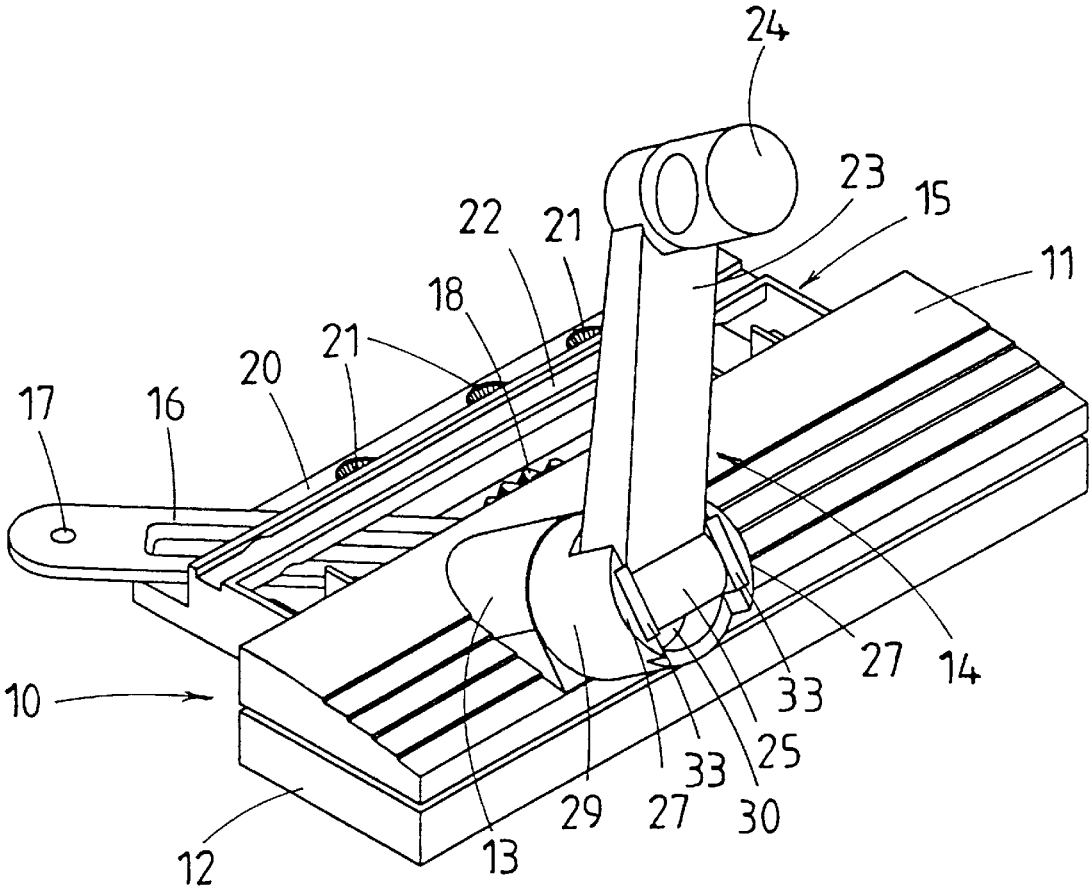
Figure 2:
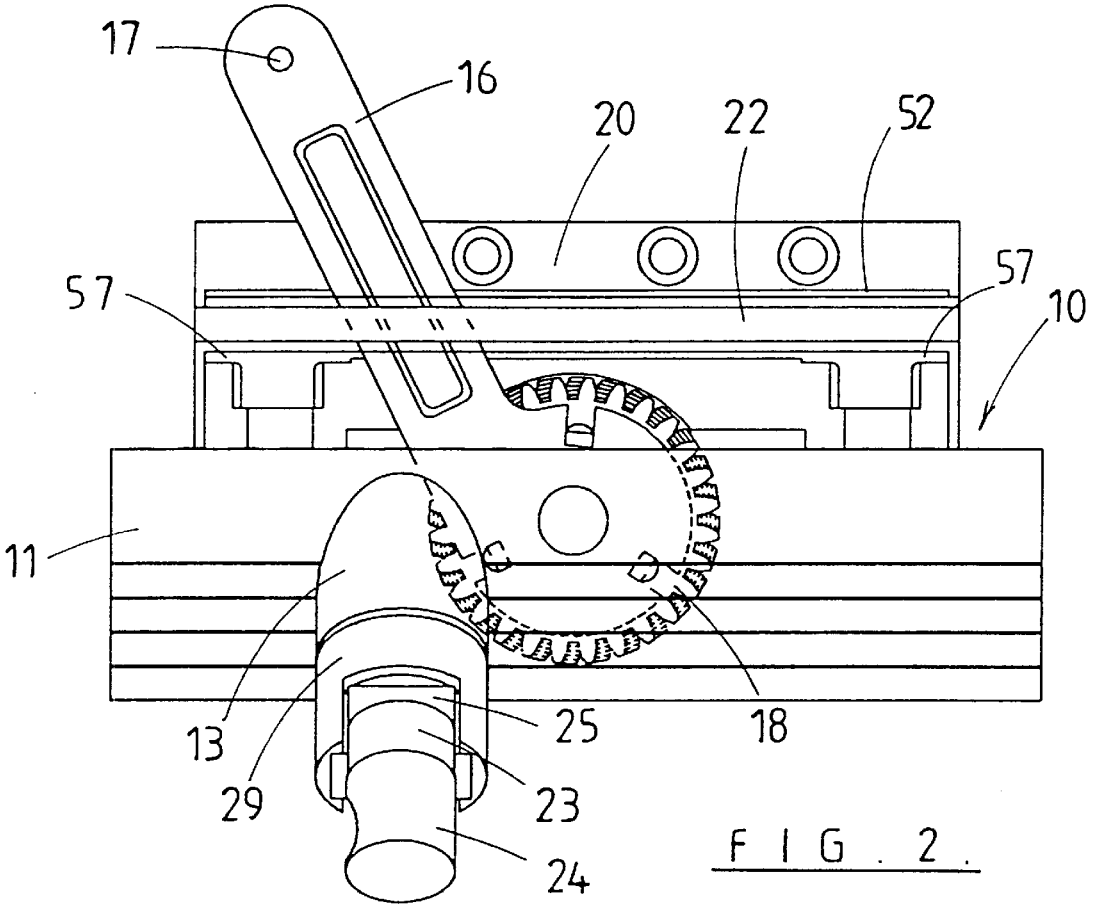

The rotary window operator according to the embodiment as illustrated comprises a housing 10 formed by a cover 11 and a base 12. A turret 13 projects from the upper surface of cover 11 and rotatably mounted therewith is a handle assembly 14. Projecting from housing 10 from one side edge thereof is a mounting frame 15.

Projecting out from the interior of housing 10 is a link arm 16. An opening 17 at the outer or free end of link arm 16 is pivotally attachable to a connecting link (not shown) extending from a window sash. The inner end of link arm 16 is coupled to a gear wheel 18.

A drive shaft 19 coupled with handle assembly 14 (as hereinafter described) carries a drive gear (not shown) which meshes with gear wheel 18. Accordingly as the handle assembly 14 is rotated drive is imparted to gear wheel 18 which in turn pivotally moves link arm 16 about the axis of rotation of gear wheel 18.

Link arm 16 moves over a land 20 formed as part of frame 15. openings 21 are formed in land 20 to facilitate mounting of the operator in a window frame as will be described later. Located above land 20 and parallel to but back toward housing 10 is a bridge 22. Thus effectively link arm 16 slidingly moves in an elongate slot defined by land 20 and bridge 22. As a consequence of bridge 22 being immediately adjacent to link arm 16 any tendency of link arm 16 to buckle upon a force being applied to the window sash (this force being transmitted via the connector link) is largely prevented.

Figure 10:
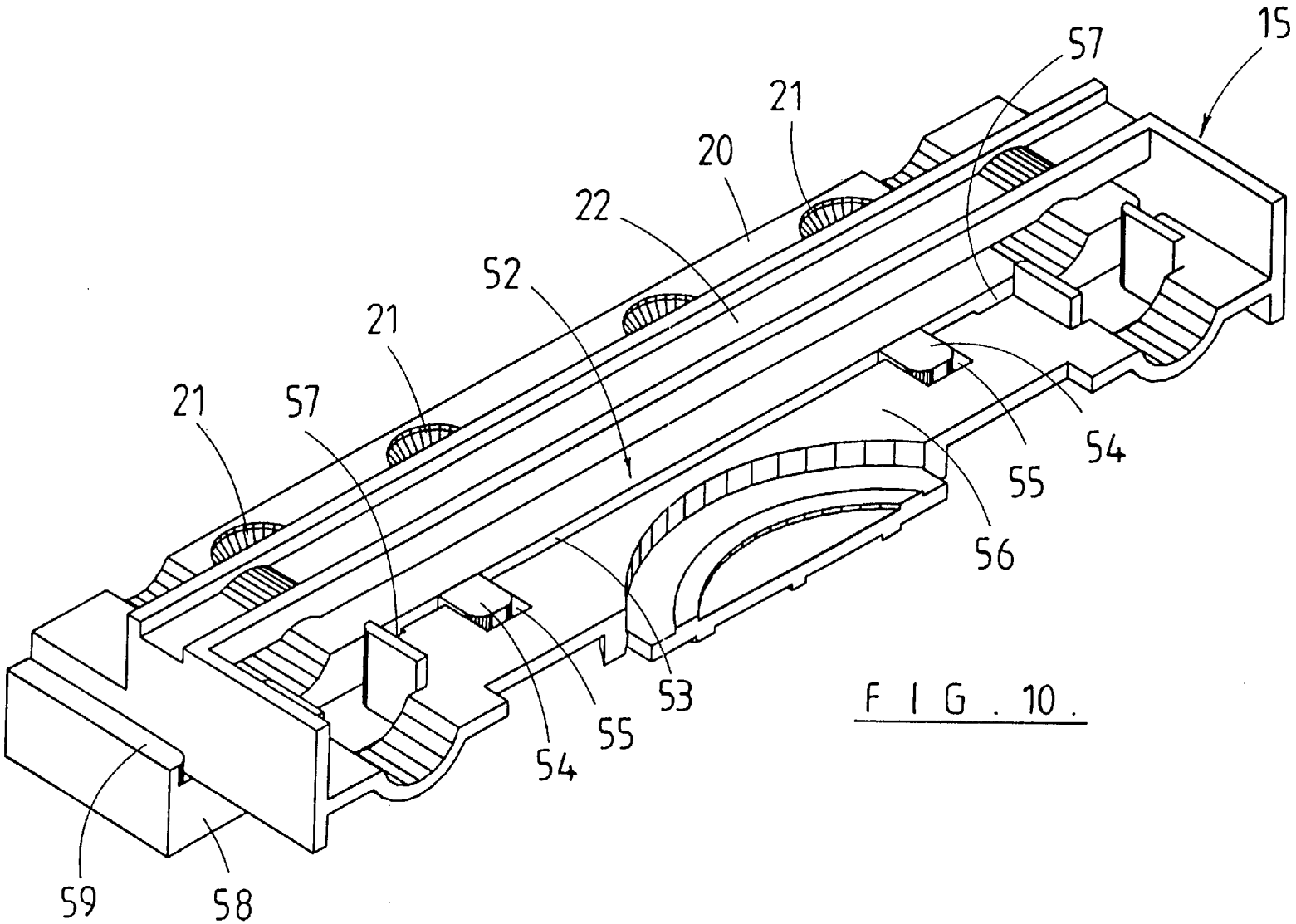

As shown in FIG. 10 a sliding surface 52 is located below and spaced from bridge 11. The link arm 16 is located in sliding contact with surface 52. In the preferred form surface 52 is formed by an elongate block 53 of plastics material which is fitted into frame 15. To this end a pair of tabs 54 projecting from block 53 engage in recesses 55 formed in the floor 56 of base 12. Likewise a pair of tabs (not shown)

projecting from the other long edge of block 53 engage in recesses in the underside of land 20. Preferably the tabs, or at least one pair thereof are of an interference fit in the respective recesses. Alternatively block 53 can be an interference fit in the area between land 20 and floor 56 where block 53 locates.

In an alternative arrangement the sliding surface 52 can be a layer of plastics material on say a metal substrate. In either case surface 52 ensures there is no sliding contact between arm 16 and a metal surface during normal operation of the operator.

The handle assembly 14 consists of a handle 23 with a rotatable knob 24 at the outer or free end thereof. The other or inner end of handle 23 incorporates a bulbous portion 25 through which a pivot pin 26 is engageable. This bulbous portion 25 engages between a pair of flanges 27. The pivot pin 26 is engaged at each end to a respective flange 27.

Engaged between bulbous portion 25 and each flange 27 is an insert 33 which is preferably made from plastics or other resilient material. An arcuate slot (not shown) is formed in each insert 33. A pin (also not shown) projecting from the side of bulbous portion 25 engages in the slot and is slidingly movable therealong as the handle 23 moves about pivot pin 26. At each end of the arcuate slot is an enlarged portion which is equal to or slightly greater than the diameter of the pin. The width of the slot is, however, less than the diameter of the pin.

Due to the resilient nature of the material the slot expands as the pin moves therealong. The enlarged portions correspond with the two extreme end positions of the handle, ie. the in-use and non-use positions. The inserts 33 therefore act as detent plates which determine the end points of travel of the handle about pivot pin 26. Due to the constricted nature of the arcuate slot a slight resistance to movement of the pin therealong occurs so that a definite click into the enlarged portion indicates to the user that an end position has been achieved. As well the handle stays in such end position due to the inability of the pin to slide along the arcuate slot until a force is applied to the handle by the user.

The drive shaft 19 extends through a bore 28 in a cage 29 to drivingly engage with a bush 30. The bush 30 is located within cage 29 and a spring 31 engages between the floor of cage 29 and a shoulder 32 of bush 30. Flanges 27 are formed as part of or are engaged with cage 29.

Opposing surfaces of cage 29 and bush 30 respectively are formed with gear teeth 34 and 35. These gear teeth 34 and 35 can mesh when the handle is in the in use position (FIG. 3) and are disengaged when the handle is folded or moved to the non-use position (FIG. 4). Gear teeth 34 and 35 thus form a saw tooth clutch arrangement.

With the handle 23 in the folded or non-use position the non meshing of gear teeth 34 and 35 result in the drive shaft 19 not being drivingly engaged with cage 29. Thus if the handle 23, when in the folded position, is rotated no drive is imparted to the drive shaft 19.

However, when handle 23 is pivoted about pivot pin 26 to the in use position, ie. in the direction of arrow B in FIG. 3 the cam profile 25*a* formed by bulbous portion 25 imparts a downward force on bush 30 against the bias of spring 31 so that teeth 34 and 35 mesh. As a consequence drive between the handle and drive shaft 19 is completed such that as the handle is rotated so too is drive shaft 19.

When the handle is moved in the direction of arrow C (FIG. 4) bush 30 moves under the influence of spring 31 which causes gear teeth 34 and 35 to disengage.

As a result of the arrangement described above handle 23 can be folded into the non-use position at any angular disposition of the handle relative to housing 10. When in the non-use position rotation of the handle does not result in any drive being imparted to the drive shaft 19. However, when handle 23 is folded back into the in use position the immediate engagement of gear teeth 34 and 35 results in drive being once again reinstated.

Figure 5:
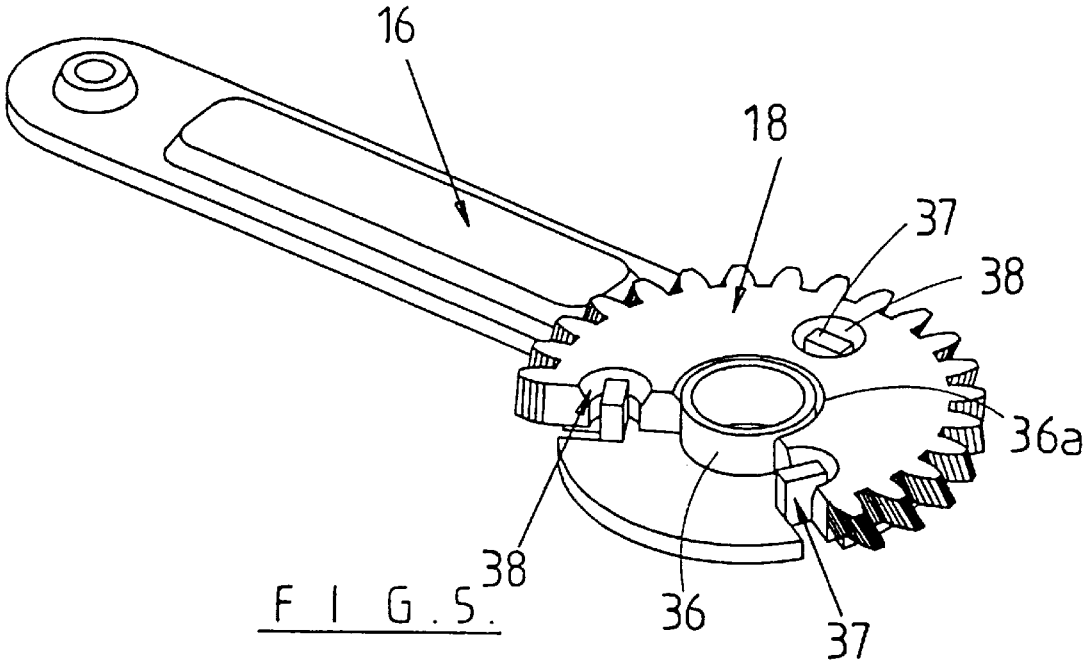
Figure 6:
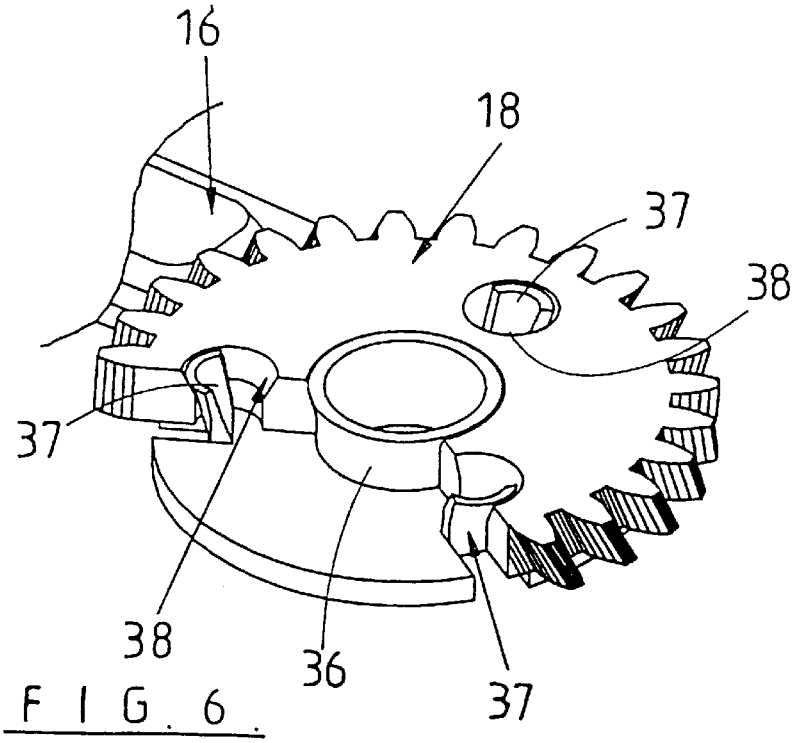

Referring now to FIGS. 5 and 6, a novel means of connecting the gear wheel 18 to link arm 16 is shown. Typically with known rotary window operators the gear wheel is formed as part of the link arm. However, according to the present invention the link arm 16 is formed with an annular wall 36 within which a pivot pin (not shown) of housing 10 can engage. The link arm 16 is thus pivotal about the axis of the pivot pin when the handle is rotated. Formed from the parent metal of arm 16 are a plurality of lugs 37 which engage within openings 38 of gear wheel 18 (see FIG. 5).

Openings 38 are countersunk so that the lugs 37 can be swagged outwardly as shown in FIG. 6 to thereby capture gear wheel 18 onto link arm 16. This enables, for example, the link arm to be made of say stainless steel and the gear wheel 18 of say a sintered material or machined from a material more suitable for gear manufacture such as free machining mild steel.

Figure 8B:
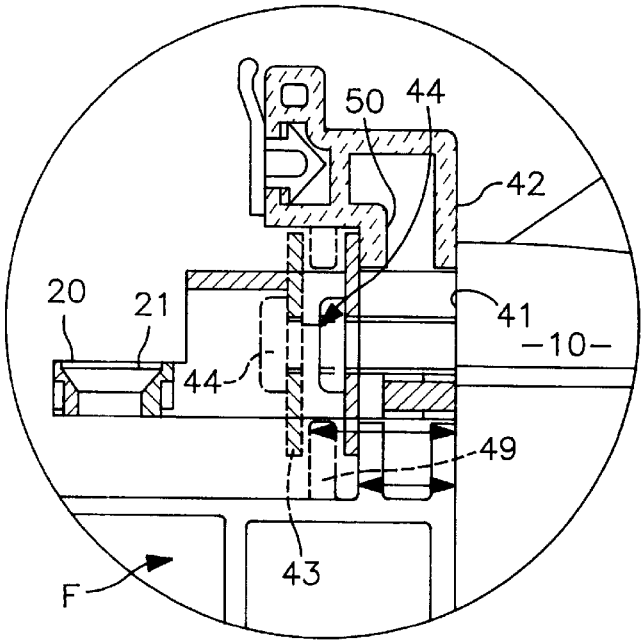
Figure 8A:
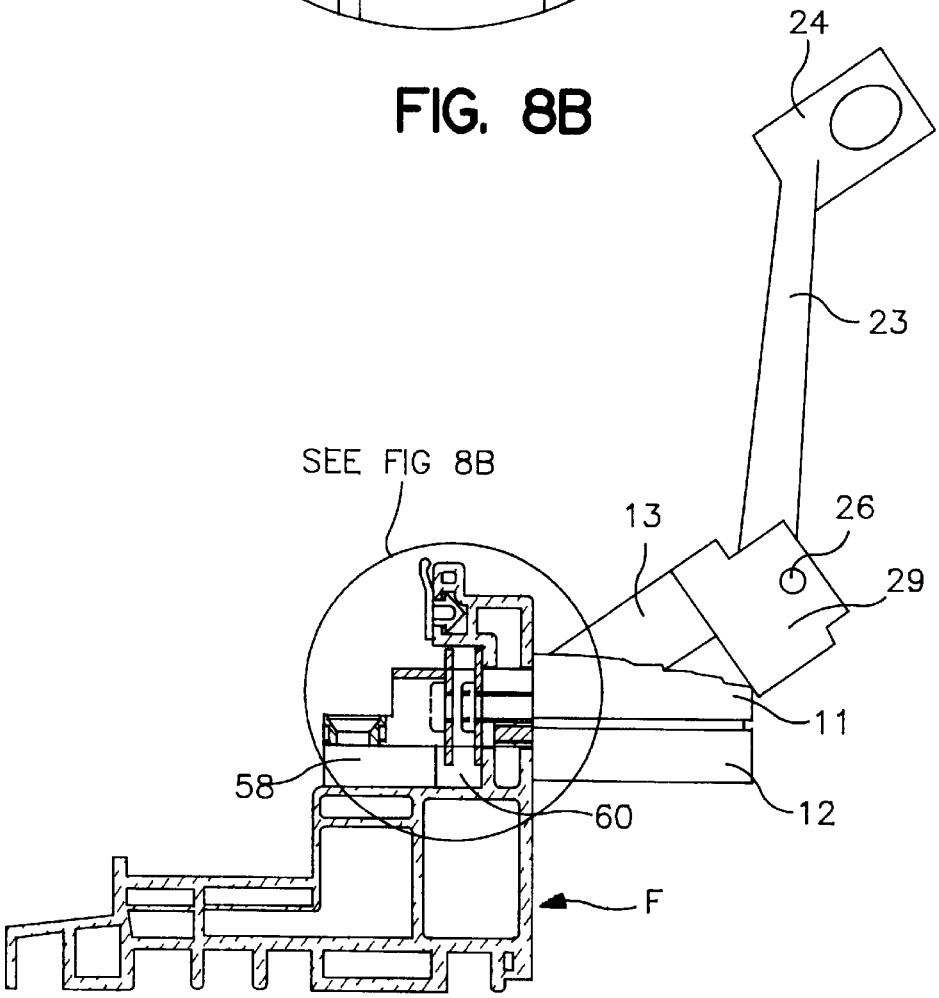
Figure 9B:
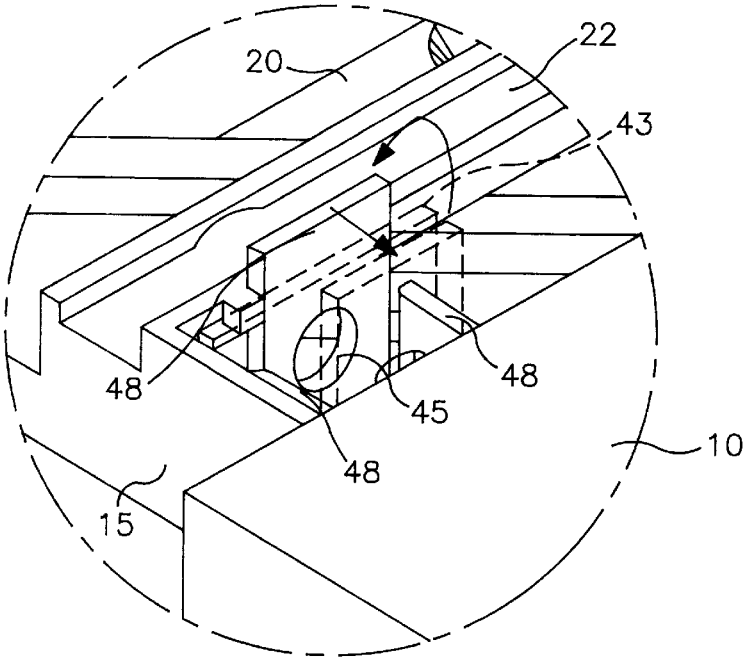
Figure 9A:
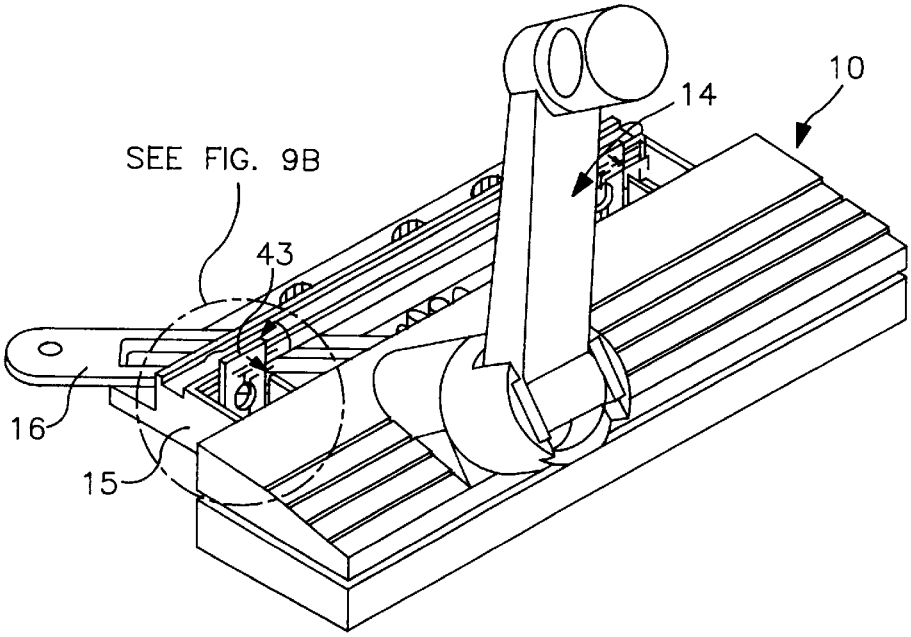

The housing 10 is typically mounted to a window frame F (see FIG. 8) by mounting frame 15 engaged through a suitably shaped opening broached in the frame (see detail illustration in FIG. 8). In the mounted position the face surface 41 of housing 10 is in abutting contact with the inner face surface 42 of frame F.

Means are provided for drawing the face surface 41 into such abutting contact with surface 42. These means include a novel arrangement, as hereinafter described, which enables the operator housing 10 to be located with frame sections of various thickness within a limited range of, for example, from ¼" to ½".

The novel fixing means consists of a pair of washers 43 which are located in pockets 57 (see FIG. 10) formed in frame 15. Pocket 57 is formed by a rebate in the edge of floor 56 and the opposing surface of block 53. Each washer is elongate and incorporates a central opening 45 through which a threaded fastener 44 engages.

Figure 7B:
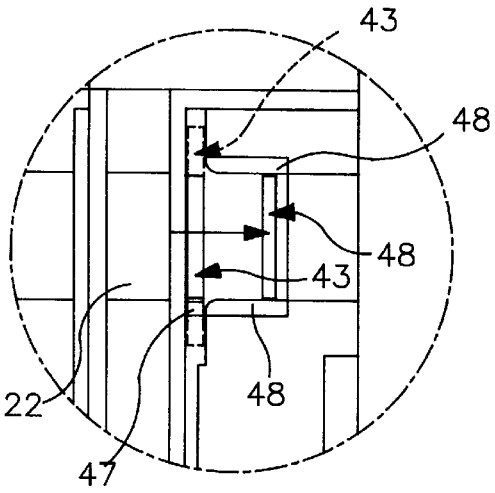
Figure 7A:
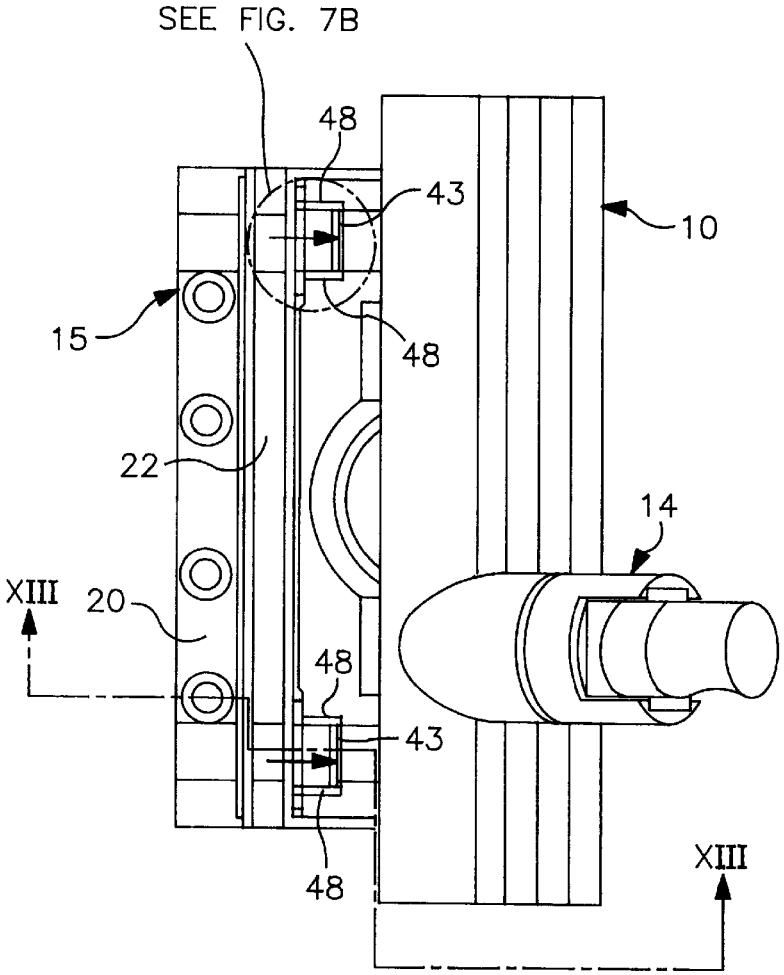

Washer 43 is located in pocket 57 on its side (see dotted detail in the enlargement of FIG. 7) so that the mounting frame 15 can be pushed through the slot formed in the frame F. The opening 45 in washer 43 is of smaller diameter than the outside diameter of fastener 44. As a consequence rotation of fastener 44 about its longitudinal axis results in the washer being able to be rotated until it is vertically orientated and engages against a lug 47.

In such position the washer is prevented by lug 47 from further rotation and is aligned between a pair of spaced apart flanges or walls 48. Further rotation of fastener 44 (the threaded end of which is located in a threaded opening in cover 11) causes the washer 43 to move forwardly until it engages against a pair of diametrically opposed upstands 49 and 50 which extend along frame F parallel to the outer wall of frame F which incorporates surface 42.

As a consequence surface 41 of housing 10 is drawn into engagement with surface 42 of frame F and the housing is thus clamped into position.

While the integral washers 43 provide for clamping in a horizontal plane they also allow for a degree of lateral adjustment of the housing relative to the frame F. As a consequence an installer can position the housing 10 and then clamp it into position by screwing in both of the threaded fasteners 44 as described above.

Within a limited range the distance between the face 42 of frame F and the diametrically opposed projections 49 and 50 can vary. This variation is accommodated by the washer 43 being movable into clamping positions within the range shown in FIG. 8 where the washer 43 is shown in dotted detail adjacent the diametrically opposed projecting walls 49 and 50 (also shown in dotted detail) at one extreme of a thicker frame section and the walls 49 and 50 shown in full at the other extreme (ie. thinner frame section).

To facilitate fixing of the housing 10 in place fasteners are engaged through openings 21 of frame 15 and into the window frame F. A packer or packers 58 (see FIG. 10) is located beneath land 10 and the adjacent portion of frame F. Preferably the packer 58 has a small rib 59 at each end thereof which engages against the side of frame 15 so as to locate the packer in position. Also the packer is so dimensioned that a gap 60 remains between the packer and wall 49. This gap leaves a clear channel should any water or moisture get in behind the packer 58.

Thus in contrast to known rotary window operators installation of the operator according to the present invention is straight forward and easy to carry out. As described above the integral washers provide a simple means of clamping the housing in position and make allowance for variations in frame thickness. It is then a simple matter of applying the fixings through openings 21 in land 20 to complete fixing of the housing 10 in the frame F.

In addition the overall top to bottom height of the mounting frame 15 is such that the opening broached in the frame can be located above the adjacent horizontal surface of the sill of the frame. As a consequence any water or moisture gaining access behind the packer 58 is not able to enter into the opening broached in the frame and therefore to the internal surfaces of the frame F. The aforementioned gap 60 between the packer 58 and the wall 49 of the frame F also ensures that no water build up occurs which could lead to water entering through the opening in the frame.

The operator according to the present invention is open to modification. A further form of the invention is, for example, shown in FIG. 11. In this form of the operator the bridge 22 is of a different configuration, but more particularly the operator includes the additional features of an adjustable connection 61 provided with link arm 62 and a screw fixing placement insert for mounting of the operator in a window construction.

Figure 11B:
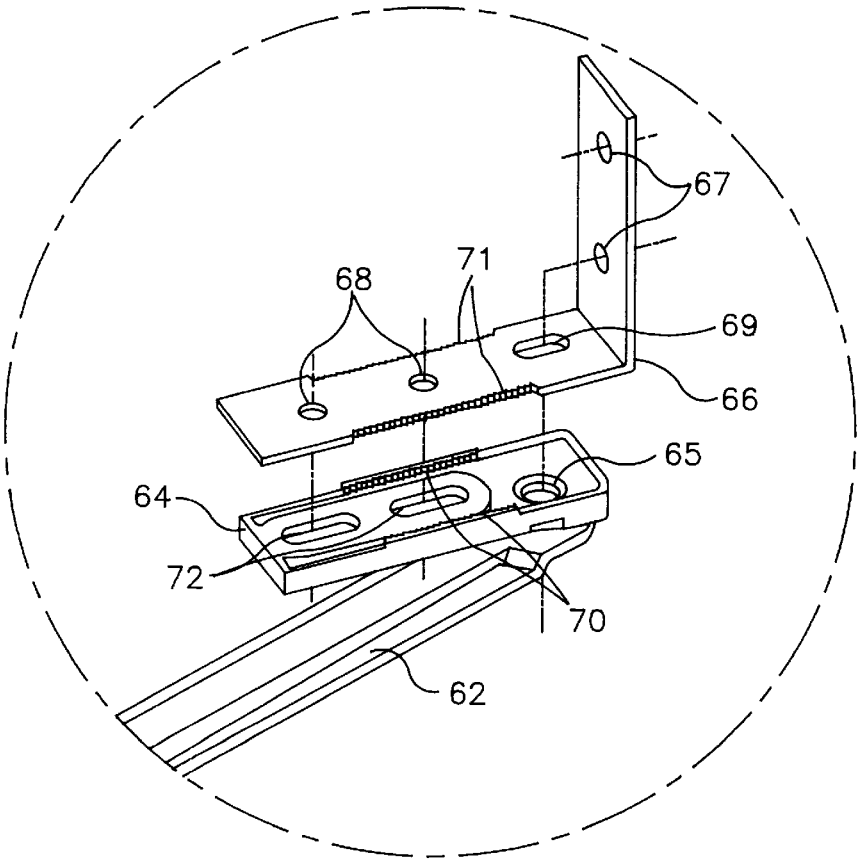
Figure 11A:
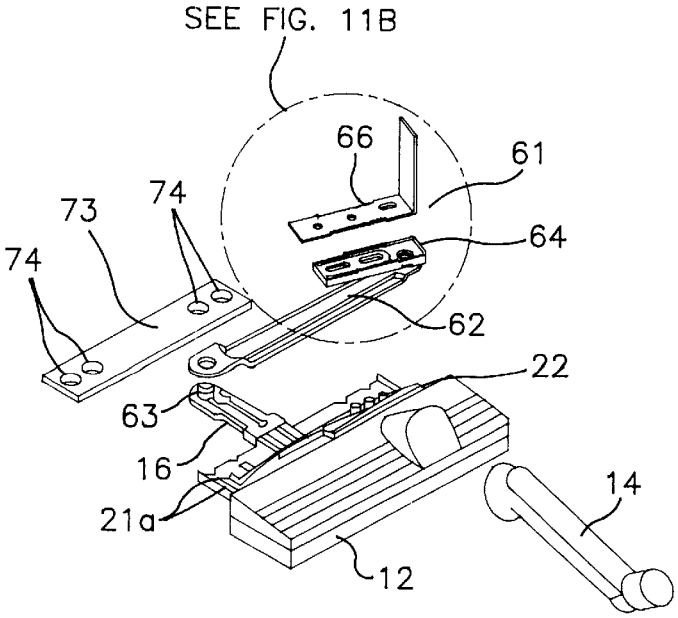

In FIG. 11 there is shown a link arm 62 which is connected via a pivot joint 63 to operator arm 16. The pivot joint 63 can be of the type described in, for example, British patent specification No 2237059. Likewise a mounting base 64 is pivotally coupled via a further pivot 65 (which in the preferred form is of the type used at pivot 63) to link arm 62. An L shaped bracket 66 is mountable to the mounting base 65. This mounting bracket 66 has a pair of openings 67 whereby the bracket can be fixedly coupled by screws (not shown) to a window sash.

Bracket 66 and the mounting base 64 are also coupled to the sash by way of screws that locate through elongate openings 72 in base 64 and round holes 68 in the mounting bracket 66. If the installation is correct then the assembly can be fixed by a countersunk head screw through the bearing 65 and corresponding slotted hole 69 in the bracket 66.

If, however, adjustment is required the two screws that locate through openings 68 can be backed off, but not removed, and the base 64 moved forwards or backwards and re-engaged by serrations 70 engaging with serrations 71 of the mounting bracket 64. Once this alignment is achieved the assembly is completed by fixing a countersunk screw through the elongate opening in the mounting bracket 64 through the bearing 65.

This adjustable fixing permits a lateral adjustment to take place and thereby achieve alignment of the sash or the operator installation if required. For example, it permits the sash to be realigned if it is out of square after it has been installed without having to relocate the operator. Similarly if the operator itself has been installed incorrectly there is some adjustment available to rectify this.

Figure 12:
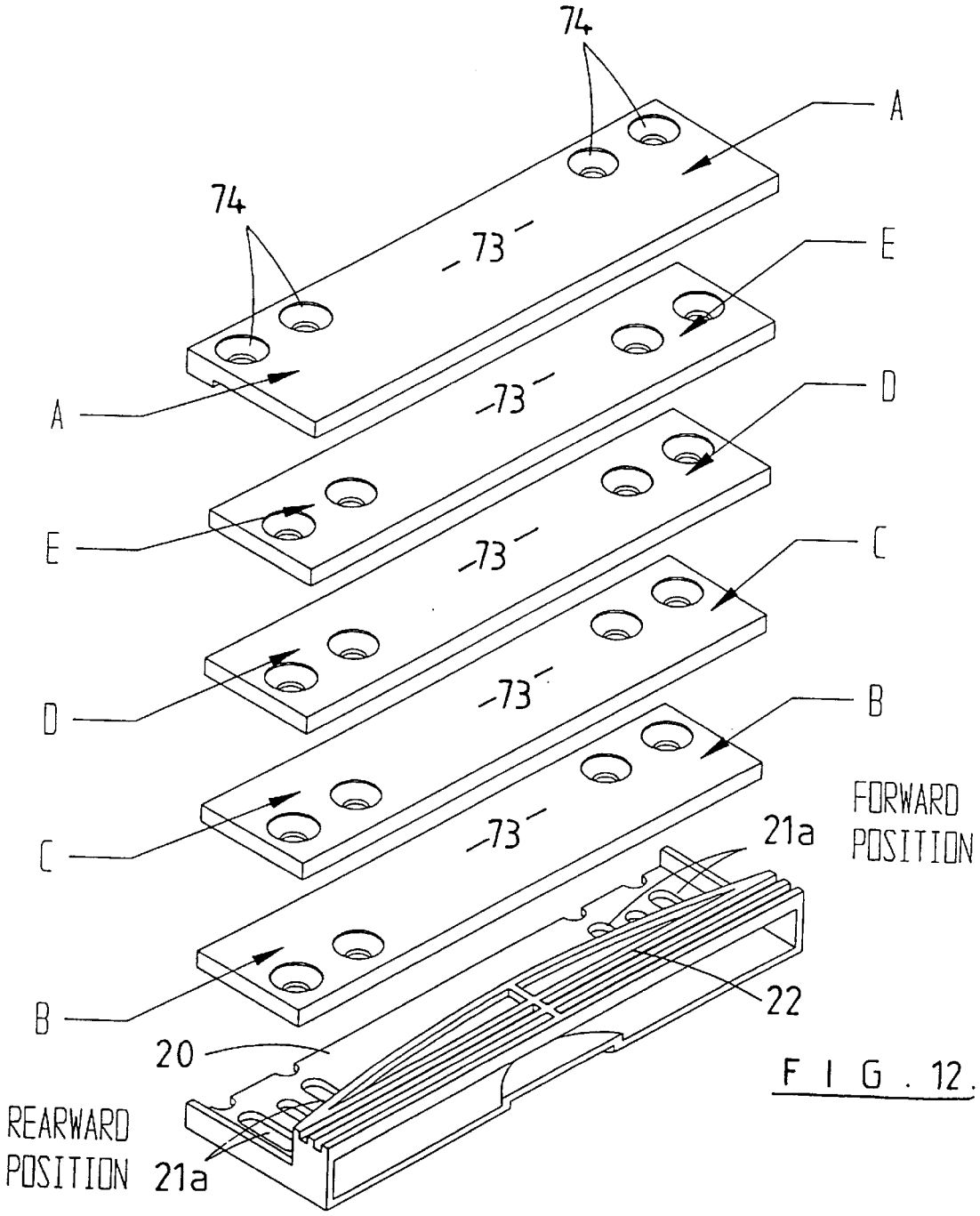
Figure 13:
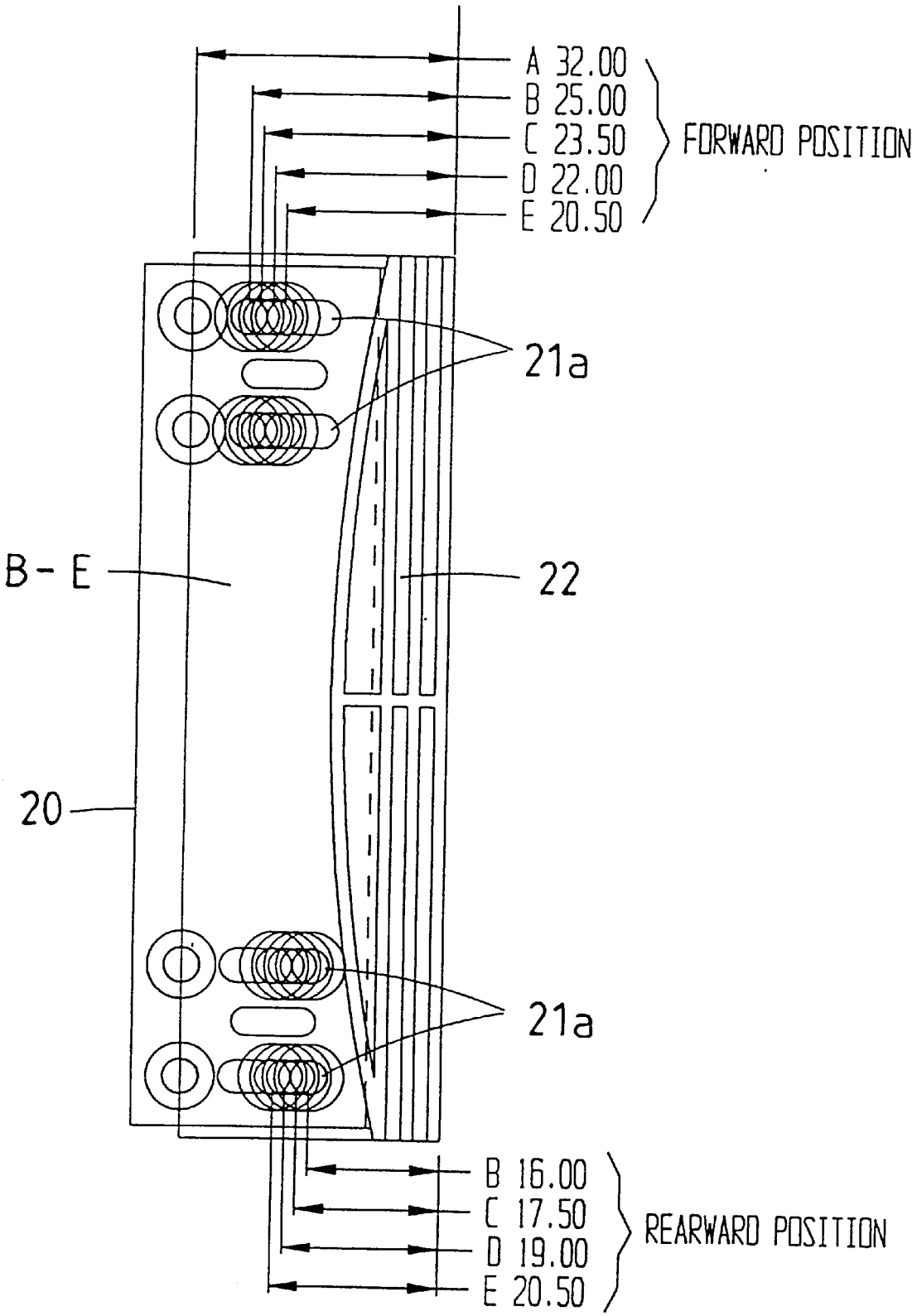

As shown in FIG. 11 the operator also includes a screw fixing placement insert 73. This insert 73 has two pairs of openings 74 which align with elongate openings 21*a* in the land 20. As shown in FIG. 12 a series of inserts A–E are provided and a selected one of these can be located and locked into the forward part 20 of the operator. In the preferred form inserts B–E are reversible and provide a discrete line of fixing by providing a countersink for a countersunk screw to locate in. The increments of these lines of fixing are depicted in FIG. 13 and it will be seen that insert A is non-reversible and provides a single discrete line of fixing as shown.

The common method of fixing a casement operator to a frame is to have single dedicated screw holes cast into the base 20 and thereby provide for one or two discrete lines of fixing. If these lines of fixing are not suitable for a particular application then either a new operator has to be made with fixings in the desired place or the fixing method is compromised. It is, however, a requirement to provide fixings from 16 mm to 32 mm out from the internal vertical face of the frame section. This can be achieved using inserts as shown in FIG. 12 which provide increments of fixing lines.

This means that end user requirements for fixing can be met with a single operator fitted with the appropriate screw insert A–E. The screw inserts A–E are of a plastic moulding thus cheap to produce and do not represent a significant capital outlay for inventory as opposed to dedicated operators for discrete fixing requirements which do represent a large capital outlay for inventory. Use of the screw inserts thus provides greater versatility for fixing of the operator.

I claim:

1. A rotary window operator which includes a rotatable handle coupled by a drive coupling to a link member;

the handle coupled to a mounting device, the handle adapted to be moveable into a non-use position where the drive coupling is disconnected;

the drive coupling comprises a first drive member coupled with said handle and a second drive member coupled to a drive shaft, said first and second drive members being rotatable relative to one another, said first and second drive members each including a plurality of teeth which come into meshing engagement upon the handle being moved to an in-use position;

said first drive member being formed by a cage to which the handle is pivotally coupled, said second drive member being formed by a bush located for axial movement within the cage, said teeth being formed on opposing surfaces of the bush and cage, said drive shaft extending through said cage and engaged within said bush.

2. A rotary window operator as claimed in claim 1 further comprising a biasing device wherein tee biasing device biases the bush to a position where the respective teeth of first and second drive members disengaged.

3. A rotary window operator as claimed in claim 2 further comprising a cam device coupled to said handle which upon the handle moving from said non-use position to said in-use position forces the bush to move against the biasing device whereupon the teeth of the bush and the teeth of the cage mesh.

4. A rotary window operator as claimed in claim 3 wherein the handle is pivotally coupled between flanges of the cage, said handle incorporating said cam device which is engaged with a pressure surface of the bush.

5. A rotary window operator as claimed in claim 1 wherein the drive coupling includes a gear wheel carried by the link member, said link member having a plurality of lugs formed integrally with the link member and engaging in spaced openings in the gear wheel.

6. A rotary window operator as claimed in claim 5 wherein the link member and gear wheel are further interconnected by a boss carried by one of said gear wheel and link member and engaging in an opening in the respective other of the gear wheel and link member, a pivot pin engaging through the boss to provide a pivotal mounting of the link member.

7. A rotary window operator as claimed in claim 5 wherein the said spaced openings in the gear wheel are countersunk and the lugs are swaged outwardly into the countersunk areas to capture the gear wheel on the link arm.

8. A rotary window operator as claimed in claim 5 wherein the link member is formed of stainless steel and the gear wheel is of sintered material or machined from free machining mild steel.

9. A rotary window operator as claimed in claim 1 wherein the link member projects from a housing, said handle being rotatably mounted with a cover of said housing, there being a mounting frame which projects from the housing adjacent to the link member.

10. A rotary window operator as claimed in claim 9 wherein the mounting frame includes a land over which the link member moves upon rotation of the handle, located to the opposite side of the link member is a bridge which is immediately adjacent to the link member.

11. A rotary window operator as claimed in claim 9 wherein the mounting frame includes a clamp device, the clamp device adapted to apply a clamping force to a portion of a window frame through which the mounting frame has been located, the window frame portion being located between the clamp device and a part of the housing of the operator.

12. A rotary window operator as claimed in claim 11 wherein the clamp device includes a pocket in the mounting frame, the clamp device having a first orientation which permits the mounting frame to be engaged through an opening formed in a window frame, said clamp device including an opening through which a fastener threaded into the operator housing can locate in an interference fit whereby rotation of the fastener causes the clamp device to move within the pocket from said first orientation to a second orientation for clamping engagement against a portion of the window frame.

13. A rotary window operator as claimed in claim 12 wherein the mounting frame includes a projection which is engageable with the clamping member to locate the clamping member in the second orientation upon rotation of the threaded fastener, there being a guide for guiding movement of the clamp device upon further rotation of the fastener.

14. A rotary window operator as claimed in claim 9 further including a packer element locatable between the mounting frame and a second portion of the window frame, said second window frame portion being located in a plane transverse to that part of the frame having the opening for the mounting frame.

15. A rotary window operator as claimed in claim 9 wherein the land includes elongate openings through which fasteners can engage to fasten the mounting frame to a window frame, there being a fixed placement insert located on the land, said insert having openings which determine the positioning of the mounting fasteners and through which the fasteners can be engaged.

16. A rotary window operator as claimed in claim 15 wherein the openings in the placement insert are countersunk to accommodate the head of the fastening engaged therein.

17. A rotary window operator as claimed in claim 15 or 16 wherein the placement insert is formed of a plastic material.

18. A rotary window operator as claimed in claim 1 further including an adjustable connection to facilitate mounting of a window sash to a link arm pivotally coupled to the link member, said connection comprising a base pivotally coupled to the end of the link arm and a bracket attachable to the sash, the position of the bracket on the base being adjustable without removal of the sash from the bracket.

19. A rotary window operator as claimed in claim 18 wherein the base is coupled to the sash via fastenings passing through elongate openings in the base and aligned openings in the bracket, there being a further fastening passing through a hollow pivot coupling the base to the link arm to the sash via an elongate opening in the bracket.

20. A rotary window operator as claimed in claim 18 or 19 wherein the bracket is formed with serrations or teeth which inter-engage with corresponding serrations or teeth of the base.

21. A rotary window operator which includes a housing having a mounting surface which in use is engageable with an outer surface of a window frame, a rotatable handle, mounting means coupling the rotatable handle to said housing, a drive coupling which couples said rotatable handle to a link member which projects from said housing, a mounting frame which projects away from said mounting surface and is adjacent said link member, a first frame mounting means having at least one bore opening to said mounting surface and adapted to receive a fastener from within the window frame relative to said outer surface to apply a mounting force to draw said mounting surface of said housing into engagement with said outer surface of said window frame, and a second frame mounting means having at least one receiving means included with said mounting frame to receive a fastening means for coupling said mounting frame to said window frame internally of said window frame relative to said outer surface and in a direction which is not the same as said fastener which draws said mounting surface into engagement with said outer surface.

22. A rotary window operator as claimed in claim 21 wherein the handle is rotatably mounted to a cover of the housing.

23. A rotary window operator as claimed in claim 21 wherein the first frame mounting means including clamping means to apply a clamping force to a portion of the window frame whereby the mounting surface is engaged with said portion of the window frame.

24. A rotary window operator as claimed in claim 21 wherein the second frame mounting means comprises a plurality of openings through which fasteners can engage to fasten the mounting frame to said window frame.

25. A rotary window operator as claimed in claim 24 further including a packer element locatable between the mounting frame and a second part of the window frame, said second part being located in a plane transverse to a part of the window frame having openings for the mounting frame.

26. A rotary window operator as claimed in claim 21 wherein the second frame mounting means comprises a plurality of elongate openings through which fasteners can engage to fasten the mounting frame to a window frame.

27. A rotary window operator as claimed in claim 26 wherein the mounting frame includes a land defining elongate openings; the land is coupled to a fixing placement insert, said insert defining openings adapted to determine a fasteners position and to engage the fasteners.

28. A rotary window operator as claimed in claim 27 wherein the openings in the placement insert are countersunk.

29. A rotary window operator which includes a housing, a rotatable handle coupled by a mounting device to the housing, the rotatable handle coupled by a drive coupling to a link member which projects from the housing, a mounting frame which projects from the housing adjacent the link member, the housing coupled by a first frame mounting device to a window frame; the mounting frame coupled by a second frame mounting device to said window frame, the first frame mounting device including a pocket in the mounting frame in which a clamping member is located in a first orientation which permits the mounting frame to be engaged through an opening formed in said window frame, said clamping member including an opening through which a fastener threaded into the housing is adapted to rotate from the first orientation to a second orientation where the clamping member engages part of the window frame.

30. A rotary window operator as claimed in claim 29 wherein the mounting frame includes a projection which is engageable with the clamping member, the projection is adapted to locate the clamping member in the second orientation, a guide coupled to the mounting frame is adapted to guide movement of the clamping member upon further rotation of the fastener.

* * * * *

UNITED STATES PATENT AND TRADEMARK OFFICE

CERTIFICATE OF CORRECTION

PATENT NO. : 5,937,582

DATED : August 17, 1999

INVENTOR(S) : Taylor

Figure 3A:
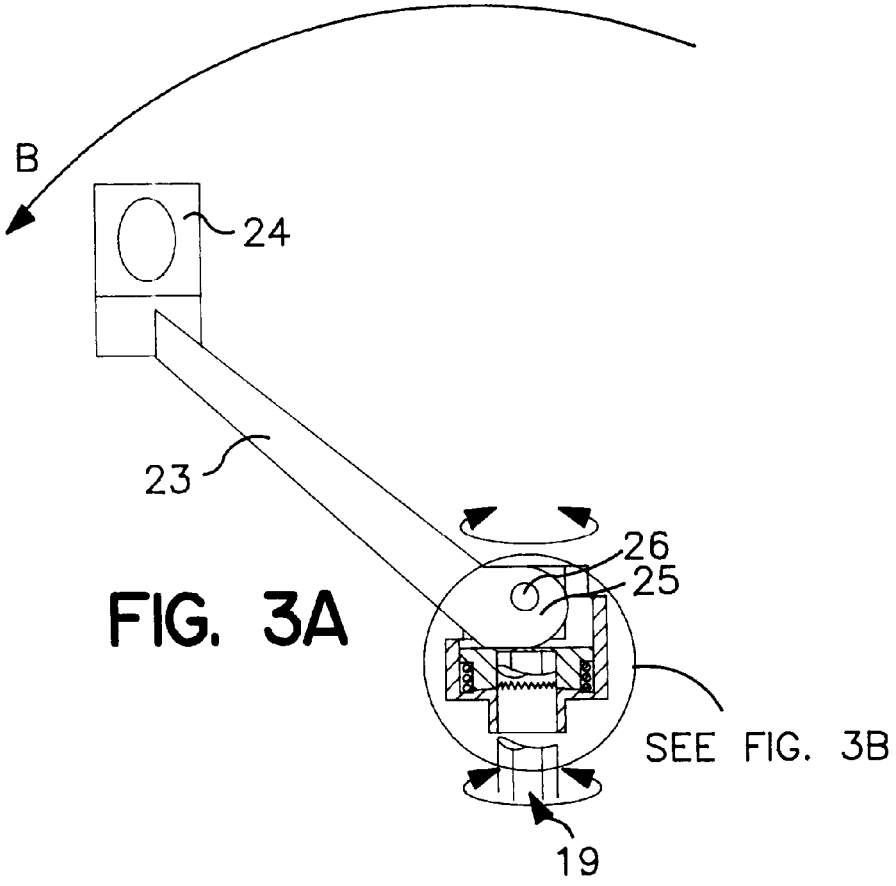
Figure 3B:
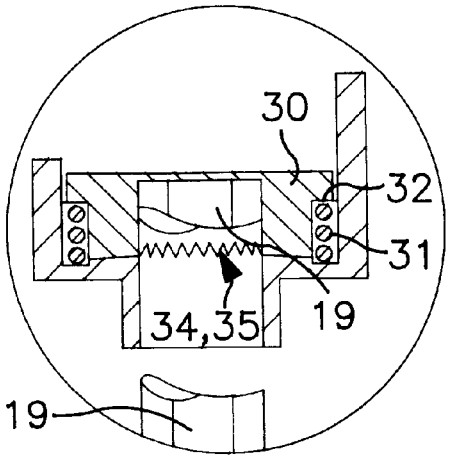

It is certified that error appears in the above-identified patent and that said Letters Patent is hereby corrected as shown below:

In column 2, line 4, delete "FIG. 3 is" and insert -- FIGS. 3A and 3B show -- .

Figure 4A:
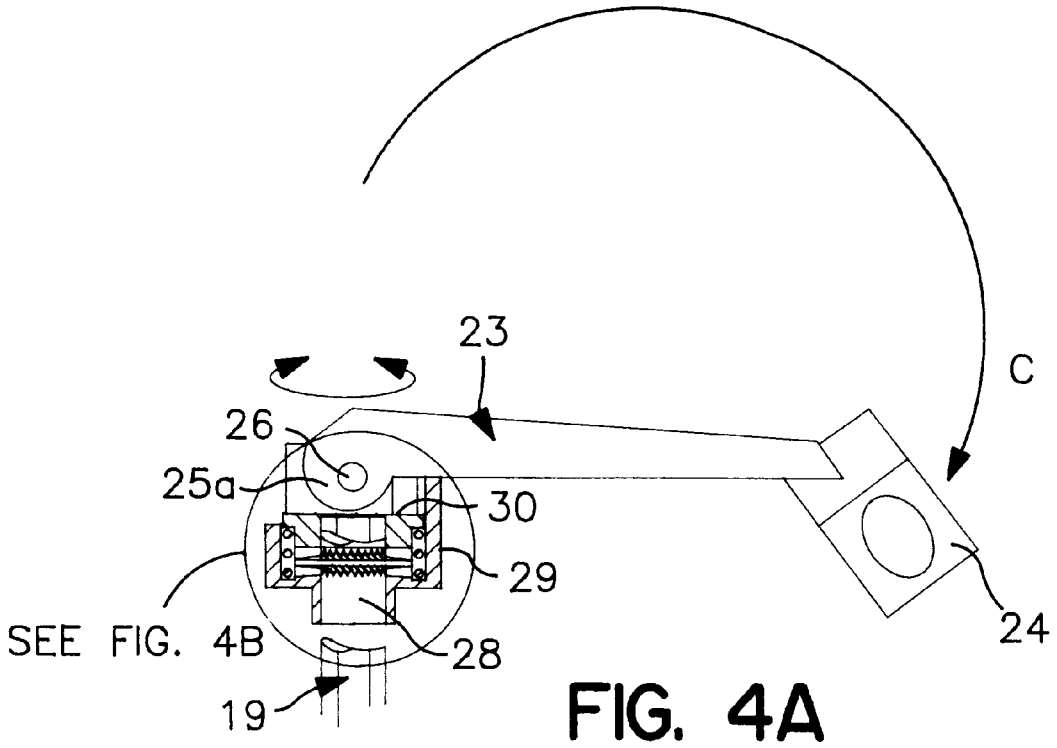
Figure 4B:
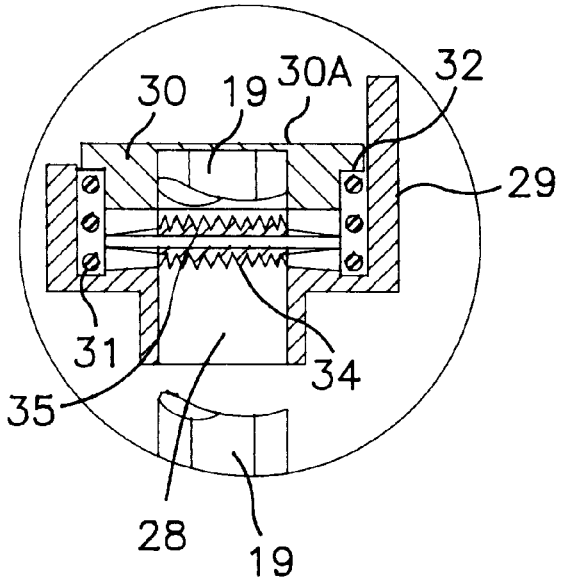

In column 2, line 6, delete "FIG. 4 is" and insert -- FIGS. 4A and 4B show -- .

In column 2, line 47, delete "openings" and insert -- Openings -- .

In column 3, line 57, delete "FIG. 3" and insert -- FIG. 3A -- .

In column 3, line 64, delete "(FIG. 4)" and insert -- (FIG. 4A) -- .

In column 6, line 63, delete "tee biasing device" and insert -- the biasing device -- .

In column 6, line 65, delete "disengaged" and insert -- disengage -- .

Signed and Sealed this

Twenty-eighth Day of November, 2000

*Attest:*

Q. TODD DICKINSON

*Attesting Officer*

*Director of Patents and Trademarks*